United States Patent [19]

Brinkman

[11] 4,120,617

[45] Oct. 17, 1978

[54] PUMP DEVICE FOR SUPPLYING FUEL TO A COMBUSTION ENGINE

[75] Inventor: Willem Brinkman, Velp, Netherlands

[73] Assignee: Holec N.V., Hengelo, Netherlands

[21] Appl. No.: 665,533

[22] Filed: Mar. 10, 1976

[30] Foreign Application Priority Data

Jan. 21, 1976 [NL] Netherlands ..... 7600624

[51] Int. Cl.[2] ..... F04B 17/00; F04B 35/04; F04B 21/02; F04B 21/04

[52] U.S. Cl. ..... 417/410; 417/536; 417/568; 123/139 E; 123/139 AD; 92/13.7; 92/245; 310/21

[58] Field of Search ..... 417/410, 415, 413, 418, 417/469, 568, 536, 534; 123/32 AE, 139 E, 139 AD, 140 MP; 92/13, 13.1, 13.5, 13.7, 245; 310/21, 36, 38, 29, 217

[56] References Cited

U.S. PATENT DOCUMENTS

| | | | |
|---|---|---|---|
| 1,534,829 | 4/1925 | Behnke | 417/417 |
| 1,850,083 | 3/1932 | Noltein | 417/568 |
| 2,148,112 | 4/1939 | Dillstrom | 92/13.1 |
| 2,315,944 | 4/1943 | Dick | 92/245 |
| 2,381,585 | 8/1945 | Gambrell | 417/499 |
| 2,458,313 | 1/1949 | Stevens | 310/19 |
| 2,646,518 | 7/1953 | Thompson | 310/21 |
| 3,003,428 | 10/1961 | Christenson | 417/441 |
| 3,103,211 | 9/1963 | Cameron | 123/140 MP |
| 3,130,333 | 4/1964 | Freye | 310/29 |
| 3,149,619 | 9/1964 | Whalen | 123/140 MP |
| 3,354,876 | 11/1967 | Durham | 123/140 MP |
| 3,408,734 | 11/1968 | Leahy et al. | 310/217 |
| 3,784,334 | 1/1974 | Hilgert | 417/410 |
| 3,877,841 | 4/1975 | Nakamura | 417/568 |
| 3,884,126 | 5/1975 | Johnson et al. | 92/13.7 |
| 3,960,127 | 1/1976 | Vuaille | 123/140 MP |

FOREIGN PATENT DOCUMENTS

| | | | |
|---|---|---|---|
| 519,679 | 2/1931 | Fed. Rep. of Germany | 123/139 AD |
| 985,469 | 7/1951 | France | 92/13.7 |
| 397,493 | 2/1932 | United Kingdom | 123/139 E |

*Primary Examiner*—Carlton R. Croyle
*Assistant Examiner*—Thomas I. Ross
*Attorney, Agent, or Firm*—John P. Snyder

[57] ABSTRACT

Device for supplying fuel to the atomizer of a combustion engine comprises at least a pump to be connected with the atomizer having a piston-bounded pump chamber and an electromagnet for reciprocating said piston.

Said device is improved, particularly with regard to the seal of the pump piston, the control and the adjustment of the pumped quantity of fuel, the life-time and the cooling of the device, the compactness and simplicity of construction and/or simplification of maintenance.

26 Claims, 11 Drawing Figures

Figures 4, 5, 6:
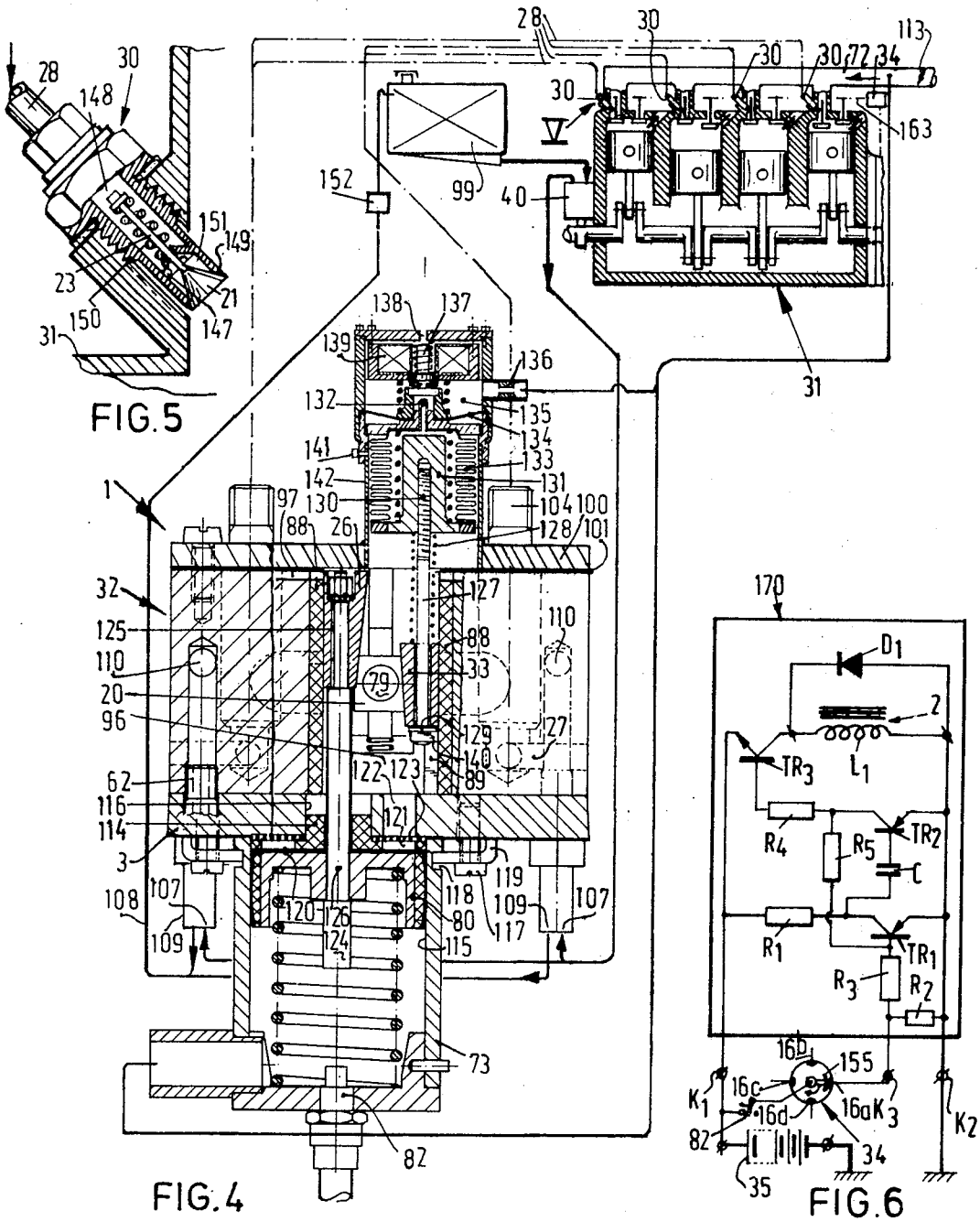

FIG.1
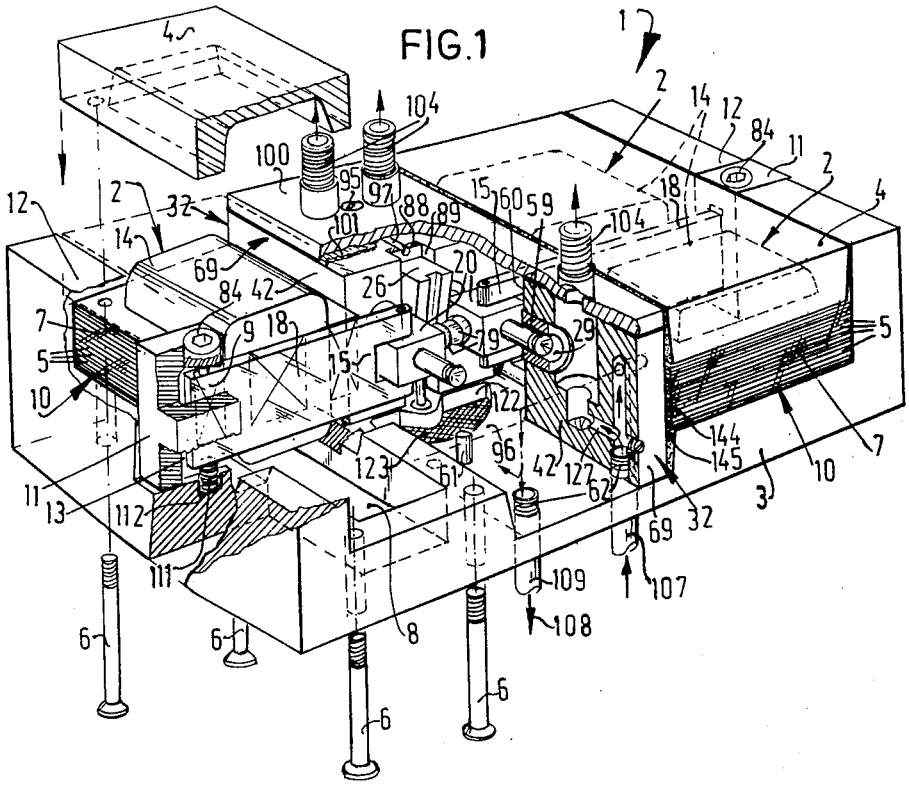
FIG.8
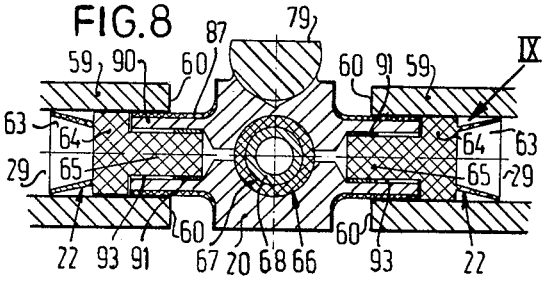
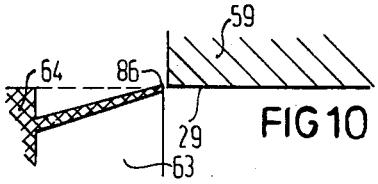
FIG10
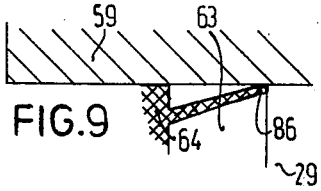
FIG.9

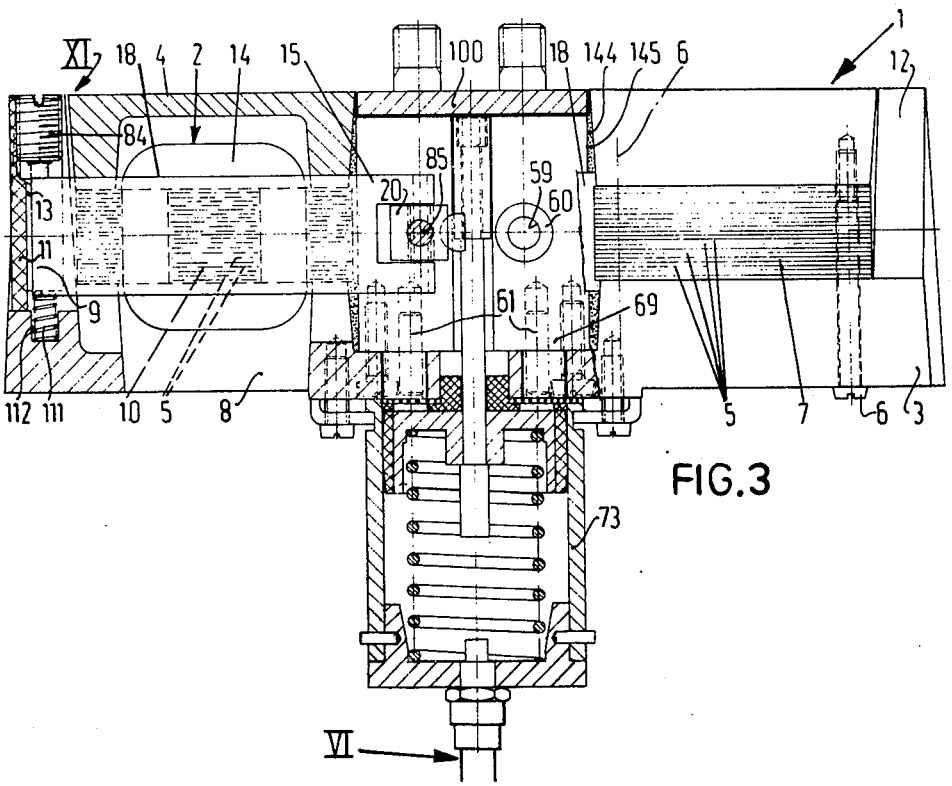
FIG.3
FIG.2
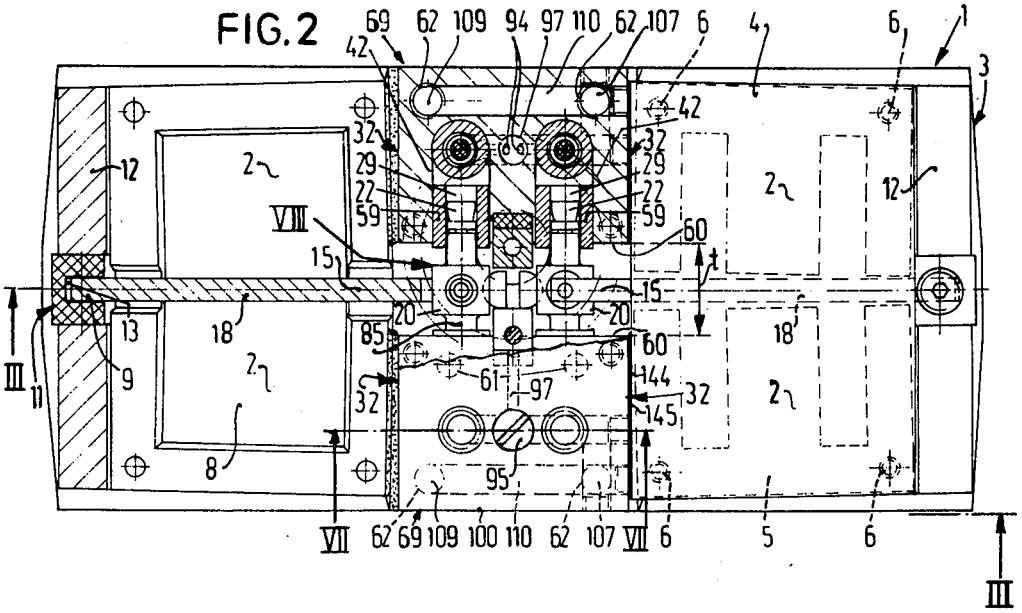

PUMP DEVICE FOR SUPPLYING FUEL TO A COMBUSTION ENGINE

The invention relates to a device for supplying fuel to the atomizer of a combustion engine comprising at least one pump to be connected with the atomizer having a piston-bounded pump chamber and driving means for reciprocating said piston. Such a device is disclosed in my now abandoned application Ser. No. 452,549 corresponding to Dutch patent application No. 73.15769 and now Pat. No. 3,994,272, and in my copending application Ser. No. 560,771 which now is Pat. 4,022,174.

The invention has for its object to provide a further improvement of the prior device, particularly with regard to the seal of the pump piston, the control and the adjustment of the pumped quantity of fuel, the lifetime and the cooling of the device, the compactness and simplicity of construction and/or simplification of maintenance.

Figure 7:
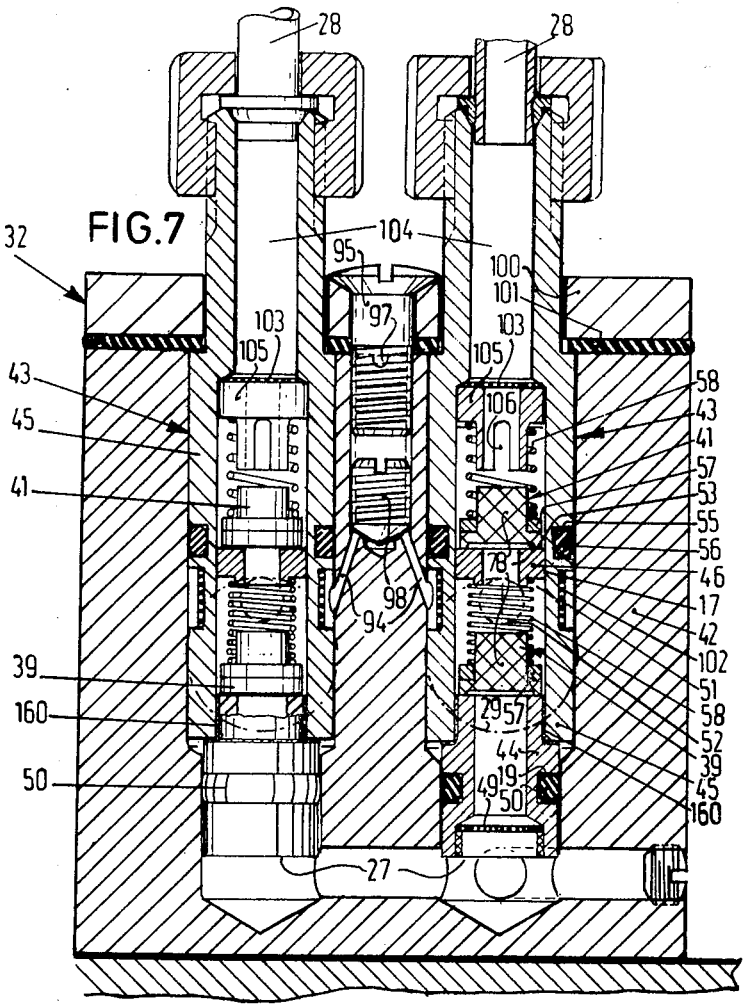
Figure 11:
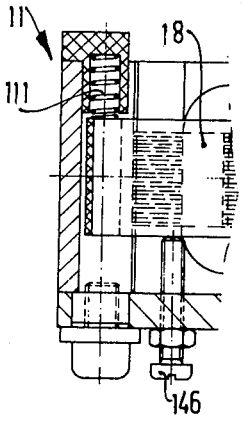

The many steps to be taken in accordance with the invention, preferably applied in conjunction, are disclosed in the claims and will be explained in the following description wth reference to a drawing. In the drawing:

FIG. 1 is a perspective elevation, partly broken away, of a preferred embodiment of a device in accordance with the invention, FIG. 2 is a plan view, partly broken away, of the device of FIG. 1, FIG. 3 is a sectional view taken on the line III—III in FIG. 2, FIG. 4 is a sectional view taken on the line IV—IV in FIG. 3, showing schematically the connection wth a combustion engine, FIG. 5 is an enlarged sectional view of a detail V in FIG. 4, FIG. 6 shows an electrical circuit diagram for use in the device of FIG. 1, FIG. 7 is an enlarged sectional view taken on the line VII—VII in FIG. 2, FIG. 8 is an enlarged, longitudinal sectional view of a detail VIII in FIG. 2, FIG. 9 shows on an enlarged scale a detail IX of FIG. 8, FIG. 10 is a sectional view corresponding to FIG. 9 in the dismounted state and FIG. 11 shows a variant of detail XI in FIG. 1.

The device 1 comprises a cast or spray-cast aluminium frame 3. Magnet plates 5 are stacked up in a jig and interconnected at their outer edges by glue 7. Two pairs of electro-magnets 2 are firmly secured by means of bolts 6 between the frame 3 and a lid 4. Each of the electro-magnets 2 comprises a core 10 formed by a packet of magnet plates 5 and an energizing coil 14 surrounding said core 10. Beneath each electro-magnet 2 the frame 3 has a wide air passage 8 allowing air to pass for cooling the electro-magnets 2. A plate-shaped armature 18 is adapted to reciprocate between each pair of alternately energized magnets 2. Each armature 18 is pivoted by an end 9 in a slot 13 of a bearing element 11 of synthetic resin, preferably Arnite, embedded in a bearing block 12, which is integral with the frame 3.

At the free end 15 each armature 18 holds a cross-shaped coupling member 20, with which are connected two displacer bodies 22 of two fuel pumps 32. The stroke of the displacer bodies 22 is determined by adjustable actuating means arranged on either side of the coupling members 20 and formed by two wedges 26 and 33. Each pump 32 comprises a pump chamber 29 accommodated in a pump housing 42 and having a fuel inlet 27 and a fuel outlet 28, each outlet leading to an atomizer 30 of a combustion engine 31. The inlet valve 39 and the outlet valve 41 are arranged in a separate valve housing 43, to be arranged in the housing 42, said valve housing comprising three parts to be interconnected i.e. an inlet seat 44, a tube 45 secured to the former by cement 160 and an outlet seat 46 secured in place in said tube 45 by cement 17. The inlet seat 44 to be connected with a fuel supply pump 40 has at the beginning a filter 49 of filter gauze and an annular groove 19 receiving a seal 50 for isolation from the pump housing 42. The tube 45 has an external annular groove 51 and a channel 52, through which the space 53 of the valve housing 43 between the inlet valve 39 and the outlet valve 41 communicates with the pump chamber 29. The tube 45 has a further annular groove 55 receiving a seal 56. All valve housings 43 are simultaneously enclosed in the pump housing 42 by means of a lid 100 with the interposition of a layer of elastic material 101. In order to avoid penetration of soil into the valve housing 43, particularly when the valve housing 43 as a unit is still located outside the pump housing 42, the fuel inlet 27 as well as each fuel outlet is provided wth a filter. For example, a cylindrical filter 102 of filter gauze is arranged in the recess 51 and a filter 103 of filter gauze is enclosed in the fuel outlet 104 with the aid of a valve stop 105, which limits the maximum height of elevation of the outlet valve 41 and which is formed by a sleeve having radial recesses 106. The inlet valve 39 and the outlet valve 41 comprise each a valve body 78 of a synthetic resin and a copper supporting ring 57 for a valve spring 58.

Into each pump housing 42 is pressed a hard steel cylinder 59 with close forced fit. The pump housings 42 are pairwise arranged coaxially opposite one another and spaced apart from one another by the front faces 60 of the cylinders 59 by means of connecting members by a distance *t*. These connecting members are formed by fitting pins 61 and tapped sleeves 62, rigidly connecting the pump housings 42 with the frame 3. The front faces 60 are accurately held in relatively parallel positions by means of the fitting pins 61. The tapped sleeves 62 constitute in addition the connecting nipples for the fuel supply conduits 107 and the fuel return conduits 108 leading to the tank 99 and a pressure control-valve 152 included therein and connected with a return outlet 109. The return outlet 109 communicates through channel 110 of the pump chambers 29 with the fuel inlet 27. Thus the fuel circulates at a high rate through the device 1 so that the fuel is not excessively heated in the device 1. It is therefore possible to mount the device 1 at a fairly hot place, for example, directly on the combustion engine 31. In ach of the two pump housings 42 a vent screw 98 common to two pump chambers 29 seals a vent channel 97, which opens out at the top of the pump housings 42 so that the emerging fuel is collected in a fuel leak collecting space 96. The vent channel 97 communicates with the pump chambers 29 through inclined channels 94. The vent screw 98 is covered by a screw 95.

The displacer bodies 22 are each made of a synthetic resin, preferably a polyamide and are each formed by a cup-shaped piston 63, a guide collar 64 engaging the pump chamber 29 and an axially extending, elastically deformable tie member 65, whose end 92 is secured with the interposition of glue 91 in a wide bore 93 of a guide member 90 of a hard steel coupling member 20. Owing to the clearance between the tie member 65 and the bore 93 the piston 63 with the guide collar 64 is displaceable in a radial direction with respect to the guide member 90. The device 1 comprises two cross-shaped coupling members 20 by which the displacer bodies 22 of each pair of fuel pumps 32 are coupled with one another. Each coupling member 20 is connected by means of an elastic coupling 66 with an armature 18. This elastic coupling 66 comprises an elastic ring 67, accommodated in the coupling member 20 and surrounding a pin 68 of the armature 18 and preferably made of a polyamide.

The displaced volume of each fuel pump 32 is determined by the stroke of the coupling member 20, which stroke is controlled by movement of a bell-shaped abutment member or arm 79 between the wedges 26 and 33. In order to obtain an accurate adjustment of said stroke both the member 79 and the wedges 26 and 33 are made of hard steel, whilst the wedges 26 and 33 accommodated each in a guide groove 89 in a pump housing 42 are in engagement with a pump housing 42 with the interposition of a supporting layer 88 of a synthetic resin, preferably Arnite. In order to avoid excessive wear of these parts the comparatively small overall bulk of the coupling member 20 and the two displacer bodies 22 connected with the former is separated from the comparatively large bulk of the armature 18 by using the elastic coupling 66. At each stroke the arm 79 of the coupling member 20 butts against a comparatively hard stop, whilst the bulk of the armature 18 continues to move over a small distance and is arrested resiliently.

Two housing blocks 69 comprise each two joined pump housings 42, between which wedges 26 and 33 are arranged to serve as common control-means for each of the pumps 32. The distance *t* and the coupling members 20 are particularly small since the wedges 26 and 33 are held in guide grooves 89 of the pump housings 42 so that inaccuracies of the fuel displacements due to deformation of coupling members and/or to mounting defects are slight. A satisfactory seal of the piston 63 is obtained since the guide member 90 guided in the cylinder 59 absorbs the tilting or cocking forces produced by the arm 79 forming a stop member striking a wedge 26 or 33 beyond the axial line 85 of the cylinder 59 and thus tending to rotate the coupling member about its pivotal connection to the armature. In order to ensure a long lifetime of the device 1 each guide member 90 is coated with a wear-resistant material 87, preferably Rilsan, which is applied by dipping and subsequently machined to the prescribed size.

In the unmounted state illustrated in FIG. 10 the sealing rim 86 of the piston 63 projects radially beyond the guide collar 64. The sealing rim 86 is sharp so that in the mounted state it assumes the satisfactorily sealing form shown in FIG. 9 and has a long lifetime, particularly if the cylinder 59 is formed by a steel sleeve.

The armature 18 engages an adjustable setting member extending at right angles to the direction of movement of said armature 18 and being formed by a set screw 84. The armature 18 is adapted to pivot about the axial line 85 and is turned about said axial line 85 during the mounting operation so that the end 9 enters the slot 13 open at the top in the bearing element 11 and is received between the set screw 84 and a spring 111 in a recess 112, the armature 18 being subsequently urged against the set screw 84, which closes the slot 13. By means of the set screw 84 the amplitude of the armature 18 turning about the axial line 85 is adjusted and hence the spot of engagement of the ball-shaped arm 79 on the stop faces of the wedges 26 and 33 extending obliquely to the reciprocatory movement of the armature 18.

The wedge 26 is driven by a piston 80 of a control-cylinder 73 communicating downstream of an air inlet valve 113 with the air inlet manifold 72 of a combustion engine 31. The control-cylinder 73, the length of which is held at a minimum, is centered with respect to the frame 3 by means of a centering disc 114, which extends into the bore 115 of the control-cylinder 73 and in a centering hole 116 of the frame 3. The control-cylinder 73 is adapted to turn about the centering disc 114 and to be fixed in the desired position by clamping means formed by clamping screws 117 and clamps 119 engaging an external groove 118 of the control-cylinder 73. The top side of the control-cylinder 73 communicates through recesses 121 in the centering disc 114 and recesses 122 in the frame 3 with a fuel leak collecting space 96 so that any leakage can flow via the outer side of the piston 80 and the control-cylinder 73 towards the inlet manifold 72. In order to maintain the cleanness of the control-cylinder 73 a filter of filter gauze is arranged between the centering disc 114 and the frame 3. Externally of the control-cylinder 73, at the end remote from the wedge 26, an axially displaceable switch 82 is controlled by an extension 124 of the piston 80 for stopping the pumps 32 in the event of a drop beneath a given pressure in the inlet manifold 72. The switch 82 can be readily actuated.

A control-rod 126 extending axially across a wide bore 125 of the wedge 26 and being rigidly secured to the piston 80 is adapted to turn with respect to the wedge 26. Owing to the clearance between the bore 125 and the control-rod 126 and to the relative rotatability of the wedge 26 and of the control-rod 126 the high-frequency vigourous impacts of the armature 18 are hardly or not at all transferred to the piston 80.

The wedge 33 is adjustable in accordance with the engine speed. A screw rod 127 extending across the wedge 33 is adapted to turn with an amount of clearance and to be displaced in a transverse direction with respect to the wedge 33, which is urged by a spring 128 against a shoulder 129 of the screw rod 127. The top end of the screw rod 127 has a screwthread 130 engaging a screwthread piece 131 of a metal bellows barometer 133. After evacuation the bellows 133 is closed by a nipple 132. The top end of the bellows 133 supports a diaphragm 134 of a pressure chamber 135, which communicates through a choke 136 with the inlet manifold 72. The pressure chamber 135 has an air inlet 138 controlled by an air valve 137. The air valve 137 is closed by an electro-magnet 139, which is energized in accordance with the speed of the combustion engine 31. The electro-magnet 139 is each time energized upon the energization of an electro-magnet 2. If the speed of the combustion engine 31 is high, the air valve 137 remains closed so that a high vacuum is produced in the pressure chamber 135, as a result of which the quantity of fuel supplied is increased. Likewise the quantity of supplied fuel increases if the barometric air pressure is high. In both cases the wedge 33 is lifted.

The pressure chamber 135 comprises a control-member formed by the diaphragm 134, which is adjustably connected with the wedge 33, since the pressure chamber 135 together with the diaphragm 134 and the barometer bellows 133 is adapted to turn with respect to the screw rod 127. Since the head 140 of the screw rod 127 is prevented from turning in the guide groove 89, the starting position of the wedge 33 can be adjusted in an axial direction. After the adjustment the pressure chamber 135 is anchored by means of a pin 141 with respect to a holder 142.

Between the pump housings 42 and the hot electro-magnets 2 air gaps 144 are provided for heat insulation. These gaps 144 are covered by elastic strips 145 to prevent penetration of soil.

Each atomizer 30 has a needle 23, a conical end 21 of which is drawn by a strong spring 150 to the seat 149 so as to establish a seal. In the event of a high fuel pressure in a chamber 148 communicating with the fuel conduit 28 and through a perforated collar 147 with a chamber 151 said end 21 is lifted from the seat 149 against the action of the spring 150 (see FIG. 5).

Each electro-magnet 2 is controlled by a circuitry 170 shown schematically in FIG. 6. The transistors $TR_1$ and $TR_2$ together with the associated resistors $R_1$, $R_2$, $R_3$, $R_4$ and $R_5$ and with the capacitor C constitute a monostable multivibrator. The resistor $R_1$ and the capacitor C determine the time constant. The collector output of the transistor $TR_2$ constitutes via the resistor $R_4$ the input of the transistor $TR_3$, which serves as an amplifier for the current to be passed through the coil $L_1$ of the electro-magnet 2. Across the coil $L_1$ is connected a quench diode $D_1$. To the input terminals $K_1$ and $K_2$ is connected a current source 35, whereas the input $K_3$ serves for the supply of a control-pulse, which may originate from a pulse generator 34, which is coupled with the engine 31. The pulse generator 34 may be coupled with a cam shaft 163 of the combustion engine 31 and has a rotating contact 155, which alternately comes into contact with one of the four contacts 16 for the energization of the subcessive electro-magnets 2.

Each of these four contacts 16 is connected to an input terminal $K_3$ of the circuitry 170. In this way the fuel required for each combustion cylinder is injected during each cycle of the combustion engine 31 at the required instant by an atomizer 30. The order of energization of the electro-magnets 2 is chosen so that in each cycle each of the wedges 26 and 33 is briefly free of a coupling member 20 so that each of them can be displaced by a slight force. The switch 82 is connected between the contact 155 and the source 35 so that in disabling the switch 82 no control-pulses are given off. The electro-magnet 139 has also a circuitry 170, whose terminal $K_3$ is connected to each of the contacts 16.

In the variant shown in FIG. 11 the set screw 146 is disposed outside of the bearing element 11 on the bottom side of the armature 18, whereas the spring 111 is arranged on the top side.

What we claim is:

1. In a device for supplying fuel to an atomizer of a combustion engine, a housing having a cylinder therein, a coupling member having an abutment member, a displacer body slidably received in said cylinder and defining a pump chamber therewith, said displacer body being connected to said coupling member in offset relation to said abutment member, drive means for moving said coupling member back and forth to reciprocate said displacer body within said cylinder, rigid stop means for engagement by said abutment member to limit movement of said coupling member, and thereby control the stroke of said displacer body, inlet valve means for allowing fuel to flow into said pump chamber as said displacer body moves in that direction increasing the volume of said chamber, and outlet valve means for allowing fuel to flow out of said pump chamber when the displacer body is moved in the opposite direction to decrease the volume of said pump chamber, the improvement wherein:

said displacer body includes a guide collar slidably received in said cylinder and an elongate, flexible tie portion extending from said guide collar to said coupling member whereby said flexible tie portion is free to deform when said coupling member tends to cock due to engagement of said abutment member against said stop means, thereby to relieve said guide collar of such cocking within said cylinder.

2. In a device as defined in claim 1 wherein said coupling member includes a tubular guide member slidably received in said cylinder and surrounding said flexible tie portion with clearance.

3. In a device as defined in claim 1 wherein said displacer body includes a cup-shaped piston integral with said guide collar and projecting therefrom at that side opposite from said flexible tie portion.

4. In a device as defined in claim 2 wherein said displacer body includes a cup-shaped piston integral with said guide collar and projecting therefrom at that side opposite from said flexible tie portion.

5. In a device as defined as in claim 4 wherein that end of the flexible tie portion remote from said guide collar is adhesively anchored in said tubular guide member.

6. In a device as defined in claim 2 wherein that end of the flexible tie portion remote from said guide collar is adhesively anchored in said tubular guide member.

7. In a device for supplying fuel to injectors of a combustion engine, housing means defining a pair of spaced housing portions, first and second cylinders in said housing portions with said cylinders being coaxially arranged, first and second displacer bodies slidably received in the respective first and second cylinders and defining respective first and second pump chambers therewith, a coupling member extending between and joining said first and second displacer bodies to each other, drive means for reciprocating said coupling member whereby to impart simultaneous reciprocations of said displacer bodies in said cylinders, said coupling member including an abutment member displaced from the common axis of said cylinders, rigid stop means for intercepting said abutment member and arresting back and forth motions of said coupling member, inlet valve means for allowing fuel alternately to flow into said first and second pump chambers, and outlet valve means for allowing fuel alternately to be discharged from said first and second pump chambers, the improvement wherein:

said coupling member includes oppositely projecting guide members respectively received in said first and second cylinders to stabilize said coupling member against rotation when said abutment member strikes said stop means, each guide member being in the form of a tube; and each displacer body including a guide collar adjacent an associated tube, an elongate, flexible tie member extending from said guide collar, with clearance, into said associated tube and having a free end anchored within such tube whereby to allow said guide collar to center itself in its cylinder independently of said coupling member.

8. In a device as defined in claim 7 wherein each guide collar is provided with a cup-shaped piston projecting from that side of the guide collar opposite said flexible tie member.

9. In a device for supplying fuel to injectors of a combustion engine, housing means defining a pair of spaced housing portions, first and second cylinders in said housing portions with said cylinders being coaxially arranged, first and second displacer bodies slidably received in the respective first and second cylinders and defining respective first and second pump chambers therewith, a coupling member extending between and joining said first and second displacer bodies to each other, drive means for reciprocating said coupling member whereby to impart simultaneous reciprocations of said displacer bodies in said cylinders, said coupling member including an abutment member displaced from the common axis of said cylinders, rigid stop means for intercepting said abutment member and arresting back and forth motions of said coupling member, inlet valve means for allowing fuel alternately to flow into said first and second pump chambers, and outlet valve means for allowing fuel alternately to be discharged from said first and second pump chambers, the improvement wherein:

said coupling member includes oppositely projecting guide members respectively received in said first and second cylinders to stabilize said coupling member against rotation when said abutment member strikes said stop means, a plate-like armature pivotally connected to said coupling member about an axis orthogonal to said common axis of said cylinder, and means pivotally mounting that end of said armature remote from said coupling member for allowing said armature to oscillate while being free to shift axially.

10. In a device as defined in claim 9 wherein said stop means comprises a first wedge backed up by one housing portion and a second wedge backed up by the other housing portion.

11. In a device as defined in claim 10 including means for adjustably rotating said armature about said common axis of said cylinders whereby to adjust the disposition of said abutment member relative to said first and second wedges.

12. In a device as defined in claim 10 wherein each of said housing portions is provided with a guide groove receiving a respective wedge.

13. In a device as defined in claim 12 wherein a thin layer of cushioning material is provided in the bottom of each guide groove.

14. In a device for supplying fuel to injectors of a combustion engine, housing means defining a pair of spaced housing portions, first and second cylinders in one of said housing portions wherein the axes of said first and second cylinders are disposed in spaced parallelism, third and fourth cylinders in the other of said housing portions with the axis of said third cylinder being coaxial with the axis of said first cylinder and the axis of said fourth cylinder being coaxial with the axis of said second cylinder, a displacer body slidably received in each cylinder, a first coupling member connecting the displacer bodies of said first and third cylinders and a second coupling member connecting the displacer bodies of said second and fourth cylinders, said first coupling member having an abutment member projecting therefrom toward said second coupling member and said second coupling member having an abutment member projecting therefrom toward said first coupling member, said abutment members being disposed in close proximity to each other, a first wedge member backed up by said one housing portion and a second wedge member backed up by said other housing portion, said wedge members being disposed between the common axis of said cylinders and being of widths sufficient to intercept the abutment members of both coupling members, a first armature pivotally connected to said first coupling member about an axis orthogonally intersecting said common axis of said first and third cylinders and projecting therefrom to present a free end remote from said first displacer body, means pivotally receiving said free end of the first armature while allowing axial movement thereof, first drive means for oscillating said first armature, a second armature pivotally connected to said second coupling member about an axis orthogonally intersecting said common axis of said second and fourth cylinders and projecting therefrom to present a free end remote from said second displacer body, means pivotally receiving said free end of the second armature while allowing axial movement thereof, second drive means for oscillating said second armature, inlet valve means for allowing fuel to flow into said cylinders, and outlet valve means for allowing fuel to be discharged from said cylinders, the improvement wherein:

means is provided for rotating at least said first armature adjustably about said common axis of said first and third cylinders whereby to adjust the contact of said abutment member of said first coupling member with said wedges relative to the contact of the abutment member of said second coupling member with said wedges.

15. In a device as defined in claim 14 including a continuous fuel flow channel in each of said housing portions, a fuel inlet connected to one end of each of said flow channels and a fuel outlet connected to the other end of each of said flow channels, means for flowing fuel continuously and under pressure through both of said flow channels, said inlet valve means comprising an inlet valve for each of said cylinders two of which are disposed between one flow channel and said first and third cylinders respectively and the other two of which are disposed between the other flow channel and said second and fourth cylinders respectively, and said outlet valve means comprising an outlet valve for each of said cylinders associated with the inlet valves of the respective cylinders.

16. In a device as defined in claim 15 wherein each inlet and outlet valve for a respective cylinder is a unitary assembly.

17. In a device for supplying fuel to an atomizer of a combustion engine, a housing having a cylinder therein, a coupling member having an abutment member, a displacer body slidably received in said cylinder and defining a pump chamber therewith, said displacer body being connected to said coupling member in offset relation to said abutment member, drive means for reciprocating said coupling member, rigid stop means for engagement by said abutment member to limit movement of said coupling member and thereby control the stroke of said displacer body, inlet valve means for allowing fuel to flow into said pump chamber as said displacer body moves in that direction increasing the volume of said chamber, and outlet valve means for allowing fuel to flow out of said pump chamber when the displacer body is moved in the opposite direction to decrease the volume of said pump chamber, the improvement wherein:

said inlet valve means and said outlet valve means are joined in a common assembly, said assembly comprising a cylindrical body defining a fuel inlet at one end and a fuel outlet at its opposite end, an inlet valve adjacent said one end and an outlet valve adjacent said opposite end and said cylindrical body having a passage between said ends communicating with said pump chamber, a first filter between said inlet valve and said one end of the cylindrical body, a second filter between said opposite end of the body and said outlet valve, and a third filter across said passage, whereby to protect said assembly against the entry of dirt even when separated from said device.

18. In a device as defined in claim 17 wherein said housing includes a continuous flow fuel channel communicating between its ends with said fuel inlet end of said assembly, and means for continuously passing fuel under pressure through said channel.

19. In a device for supplying fuel to injectors of a combustion engine, housing means defining a pair of spaced housing portions, first and second cylinders in said housing portions with said cylinders being coaxially arranged, first and second displacer bodies slidably received in the respective first and second cylinders and defining respective first and second pump chambers therewith, a coupling member joining said first and second pistons, drive means for reciprocating said coupling member whereby to impart simultaneous reciprocations of said pistons in said cylinders, said coupling member including an abutment member displaced from the common axis of said cylinders, rigid stop means for intercepting said abutment member and arresting back and forth motions of said coupling member, inlet valve means for allowing fuel alternately to flow into said first and second pump chambers, and outlet valve means for allowing fuel alternately to be discharged from said first and second pump chambers, the improvement wherein:

said inlet valve means comprising a first inlet valve associated with said first cylinder and a second inlet valve associated with said second cylinder, said outlet valve means comprises a first outlet valve associated with said first cylinder and a second outlet valve associated with said second cylinder, said first inlet valve and said first outlet valve being housed in a first common assembly and said second inlet valve and said second outlet valve being housed in a second common assembly, each common assembly comprising a cylindrical body presenting a fuel inlet at one end and a fuel outlet at its opposite end and having a passage between its ends communicating with a respective cylinder, and the inlet valve thereof being disposed between said one end and said passage while the outlet valve is disposed between said opposite end and said passage, each common assembly also including a first filter between the inlet valve and said one end of the cylindrical body, a second filter between said opposite end of the body and the outlet valve, and a third filter across the passage, whereby to protect each assembly against the entry of dirt even when separated from said device.

20. In a device as defined in claim 19 including means for limiting the movement of said outlet valve within said cylindrical body. between its ends communicating with a respective cylinder, and the inlet valve thereof being disposed between said one end and said passage while the outlet valve is disposed between said opposite end and said passage.

21. In a device as defined in claim 19 wherein one housing portion is provided with a recess slidably receiving one common assembly and the other housing portion is provided with a recess slidably receiving the other common assembly, and a lid removably retaining both common assemblies in place.

22. In a device as defined in claim 21 wherein one housing portion is provided with a continuous fuel flow channel communicating with the inlet end of one common assembly and the other housing portion is provided with a continuous fuel flow channel communicating with the inlet end of the other common assembly, and means for continuously flowing fuel under pressure through said channels.

23. In a device as defined in claim 19 wherein one housing portion is provided with a continuous fuel flow channel communicating with the inlet end of one common assembly and the other housing portion is provided with a continuous fuel flow channel communicating with the inlet end of the other common assembly, and means for continuously flowing fuel under pressure through said channels.

24. In a device for supplying fuel to an atomizer of a combustion engine, a housing having a cylinder therein, a coupling member having an abutment member, a displacer body slidably received in said cylinder and defining a pump chamber therewith, said displacer body being connected to said coupling member in offset relation to said abutment member, drive means for moving said coupling member back and forth to reciprocate said displacer body within said cylinder, rigid stop means for engagement by said abutment member to limit movement of said coupling member and thereby control the stroke of said displacer body, inlet valve means for allowing fuel to flow into said pump chamber as said displacer body moves in that direction increasing the volume of said chamber, and outlet valve means for allowing fuel to flow out of said pump chamber when the displacer body is moved in the opposite direction to decrease the volume of said pump chamber, the improvement wherein:

said stop means includes an axially shiftable wedge member and a frame is provided on which said housing is affixed, said frame having an opening therethrough aligned with wedge member, a control cylinder fixed to the underside of said frame and a control piston slidably received in said control cylinder, said wedge member having a control rod connected to said control piston, and a centering disc having a first portion snugly received in said opening in the frame and a second portion snugly received in said control cylinder, wherein said control rod passes axially through said wedge member, with clearance, to allow said wedge member to shift laterally with respect to said control rod while allowing the latter to rotate with respect thereto.

25. In a device for supplying fuel to an atomizer of a combustion engine, a housing having a cylinder therein, a coupling member having an abutment member, a displacer body slidably received in said cylinder and defining a pump chamber therewith, said displacer body being connected to said coupling member in offset relation to said abutment member, drive means for moving said coupling member back and forth to reciprocate said displacer body within said cylinder, rigid stop means for engagement by said abutment member to limit movement of said coupling member and thereby control the stroke of said displacer body, inlet valve means for allowing fuel to flow into said pump chamber as said displacer body moves in that direction increasing the volume of said chamber, and outlet valve means for allowing fuel to flow out of said pump chamber when the displacer body is moved in the opposite direction to decrease the volume of said pump chamber, the improvement wherein:

said stop means includes an axially shiftable wedge member and means for axially shifting said wedge member, a control rod and a stop at one end of said control rod which engages said wedge, said control rod passing axially through said wedge member and fixed at its free end to said means for axially shifting, spring means urging said wedge against said stop, said wedge member receiving said control rod with clearance to allow said control rod to rotate with respect thereto while allowing said wedge member to shift laterally with respect to said control rod.

26. In a device as defined in claim 25 wherein said spring means surround said rod and acts between said wedge member and said means for axially shifting.

* * * * *